United States Patent [19]

Geer et al.

[11] 4,353,621

[45] Oct. 12, 1982

[54] OPTICAL TOYS FOR REVERSING SIGHTED IMAGES

[76] Inventors: Mary W. Geer, 14024 SE. 44th Pl., Bellevue, Wash. 98006; Charles W. Geer, deceased, late of Bellevue, Wash., by Mary W. Geer, executrix

[21] Appl. No.: 914,027

[22] Filed: Jun. 9, 1978

[51] Int. Cl.[3] ..... G02B 7/18; A63H 33/22

[52] U.S. Cl. ..... 350/145; 350/287; 350/297; 350/298; 350/299; 272/8 M

[58] Field of Search ..... 350/286, 287, 297, 298, 350/145, 299; 272/8 M

[56] References Cited

U.S. PATENT DOCUMENTS

| | | | |
|---|---|---|---|
| 714,383 | 11/1902 | Lippincott | 350/297 |
| 863,407 | 8/1907 | Lancaster | 350/297 |
| 1,027,576 | 5/1912 | Victor | 350/297 |
| 2,291,104 | 7/1942 | Radzyner | 350/297 X |
| 2,327,700 | 8/1943 | Eddy | 350/297 |
| 3,039,351 | 6/1962 | Spagna et al. | 350/287 X |
| 3,074,319 | 1/1963 | McGovern | 350/297 |

*Primary Examiner*—F. L. Evans
*Attorney, Agent, or Firm*—Gregory W. Moravan

[57] ABSTRACT

Embodiments of optical toys for reversing sighted images are used by individuals for their personal enjoyment and their enjoyment with others in playing games. When these toys are held closely adjacent to their eyes and then, while viewing the reversed scene before their eyes, they try to maneuver ahead, for example, to follow a reversed curved pathway. In a preferred embodiment, two right angle solid optical prisms are mounted in spaced relationship on a hand held housing, so one prism is opposite each eye, with one of its right angle sides positioned at a forty-five degree angle flaring outwardly, as its hypotenuse side is pointed directly ahead of the person. In another embodiment, instead of the solid optical prisms, multiple angled interconnected reflective surface units are arranged before each eye and they are respectively supported on an eyeglass-like frame. A timing device may be inserted in the housing when games are played in accordance with a preset game time period. Also viewing with both eyes through just one solid prism, after its rotation ninety degrees to a horizontal position, may be undertaken for additional enjoyment.

7 Claims, 8 Drawing Figures

OPTICAL TOYS FOR REVERSING SIGHTED IMAGES

BACKGROUND OF THE INVENTION

In 1911 Frank Miele, in his U.S. Pat. No. 999,512, disclosed his illusion device in which optical prisms were arranged, so a person viewing through his illusion device held before his eyes, depending on its horizontal reversible position, either realized, via his sighted image, an image enlarged or reduced in the vertical dimension; and depending on its vertical reversible position, either realized, via his sighted image, an image enlarged or reduced in the horizontal dimension. Apparently no one else in U.S. patents, or in the present U.S. market places, has proposed or provided optical toys to be hand held to view changed images for his entertainment.

SUMMARY OF THE INVENTION

For a person's individual enjoyment or his or her group entertainment, an optical toy for reversing sighted images is provided for playing games, such as walking ahead while trying to step on a rope or other pathway arranged along a curved pathway, and quite often being required to complete this trip over the full length of the rope or other pathway during a given limited time allotted to each participant. In a preferred embodiment, right angle solid optical prisms are spaced on a hand held housing, so each prism is held opposite a respective eye. Each prism has one of its right angle sides positioned at a forty-five degree angle flaring outwardly, as its hypotenuse side is pointed directly ahead of the person. The sighted image is the reverse of the actual curved pathway determined by the rope or other pathway laid on the ground or floor and the feet are reversed apparently, right to left, making the person's actual continuing foot contact with the rope or other pathway most difficult and entertaining.

In another embodiment multiple angled interconnected reflective surface units are arranged in opposite hand groups for positioning before respective eyes, as they are preferably held in place by eyeglass like frames. The hand held housing has at least one handle and may have two or may have none. A timer may be included within the housing. Viewing with both eyes through one of the prisms, then in a horizontal position, also serves as a source of entertainment, to give the illusion of walking on the ceiling.

DESCRIPTION OF THE DRAWINGS

Respective embodiments of the optical toys for reversing sighted images are illustrated in the drawings, wherein.

DESCRIPTIONS OF THE DIFFERENT EMBODIMENTS

REGARDING ALL EMBODIMENTS

This optical toy in all its embodiments is arranged so a participant in sighting through his or her respective eyes encounters before each of his or her eyes respective light path reversing means, thereby reversing sighted images. These light path reversing means are respectively available in either an individual solid prism or in a group of multiple angled interconnected reflective surface units. Various support means for spacing and holding the light path reversing means are used, with hand held housings generally supporting the solid prisms, and nose and ear supported eyeglass like frames holding the group of multiple angled interconnected reflective surface units. As seen in FIGS. 1–4, both of the light path reversing means 16, 18, have a length which is preferably at least about equal to one-half of the distance from the participant's eyebrow to his chinline, or which is at least about two inches long, so the participant may usually view at least one of his feet as well as a substantial portion of the pathway means 24.

REGARDING THE HAND HELD HOUSINGS POSITIONING THE SOLID PRISMS TO REVERSE THE SIGHTED IMAGES

Figure 1:
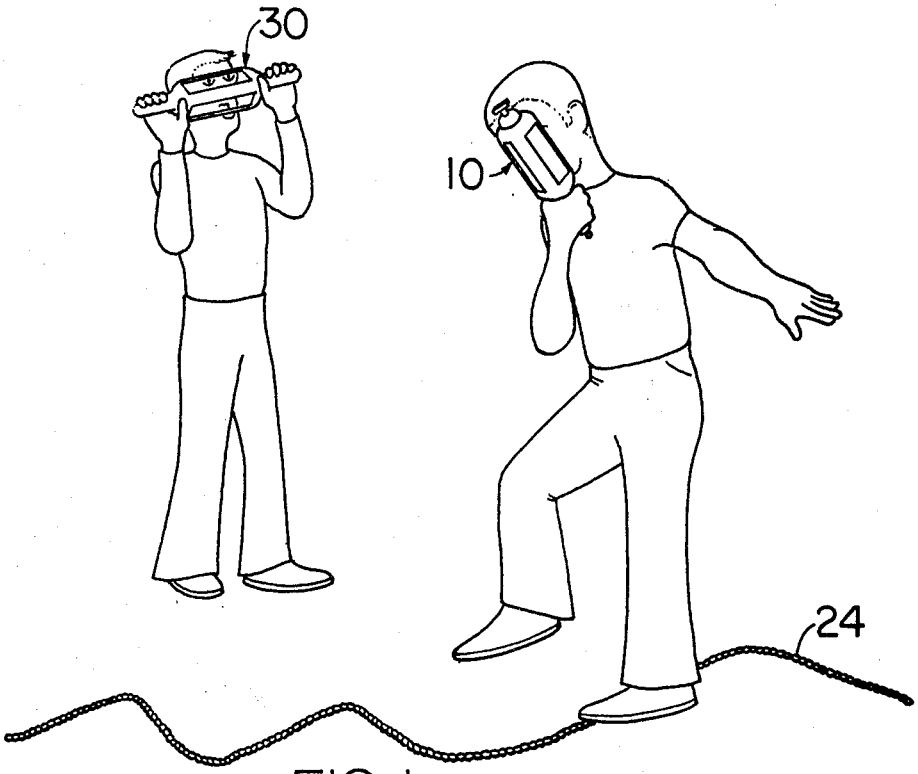
FIG. 1 is a perspective view illustrating a person holding one embodiment of the optical toy having one handle and a timer, before his eyes with the prisms arranged vertically before each eye, as he tries to step on a rope or other pathway arranged on a floor or the ground along a curved passageway, and also showing a person using another embodiment with two handles, arranged with the prisms positioned horizontally, with his eyes looking through one prism.
Figure 2:
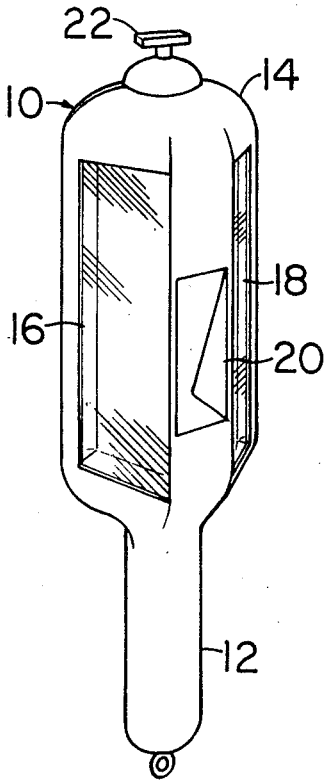
FIG. 2 is an enlarged perspective of an embodiment of the optical toy, equipped with solid prisms, one handle, and a timer.
Figure 3:
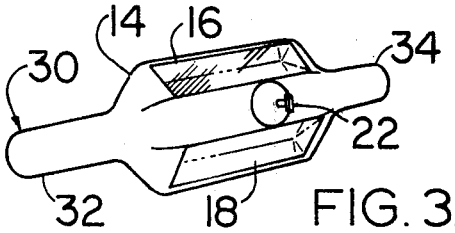
FIG. 3 is a smaller perspective view of another embodiment of the optical toy, equipped with solid prisms, two handles, and a timer.

As illustrated in FIGS. 1, 2, 3, 5, 6, and 7, a person individually or with a group watching and awaiting their turn, holds this embodiment of the optical toy 10, by grasping a depending handle 12 generally made integral with the housing 14, which in turn holds the two solid optical prisms 16, 18, a spaced distance apart to position them before the respective eyes of the participant in the game. An optional recess 20 is formed in the housing 14 to accommodate the nose of the participant. Optionally a timer 22 is installed in the housing 14 to set a standard time for all participants to play a game. Such a game is illustrated in FIG. 1, where a boy is illustrated trying to continue stepping on a rope 24 or other pathway, which has been laid on the ground or on a floor to determine a curved pathway. With the boy viewing the rope and his feet via the reversed image, the coordination of his steps becomes a challenge, and a source of excitement for him and those viewing his efforts.

Also in FIG. 1, another boy is shown using an optical toy 30, having two handles 32, 34, and he is using this toy 30 in a horizontal position to view redirected images through both eyes using the same prism giving the illusion of walking on the ceiling. It also is useable in a vertical position with each eye using a respective prism 16, 18.

REGARDING THE EYE FRAME LIKE SUPPORTED GROUPS OF MULTIPLE ANGLED INTERCONNECTED REFLECTIVE SURFACE UNITS

Figure 4:
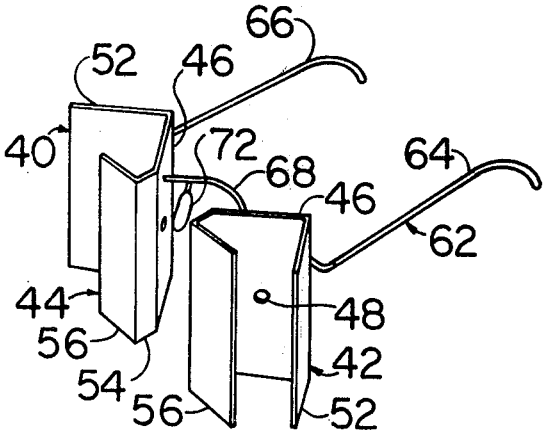
FIG. 4 is a perspective view of another embodiment of the optical toy equipped with respective sets of multiple angled interconnected reflective surface units supported on eyeglass like frames.
Figure 5:
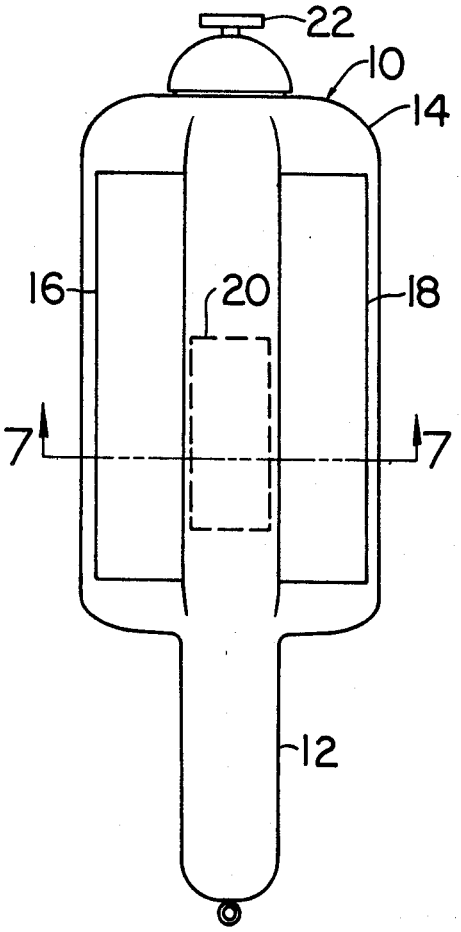
FIG. 5 is an elevational view of the embodiment illustrated in FIG. 2, illustrating a participant's view of the portions moved up to his or her face, indicating the spacing of the prism to be placed before the eyes of the user, and also showing the recessed portion of the hand held housing to clear the nose of the user.
Figure 6:
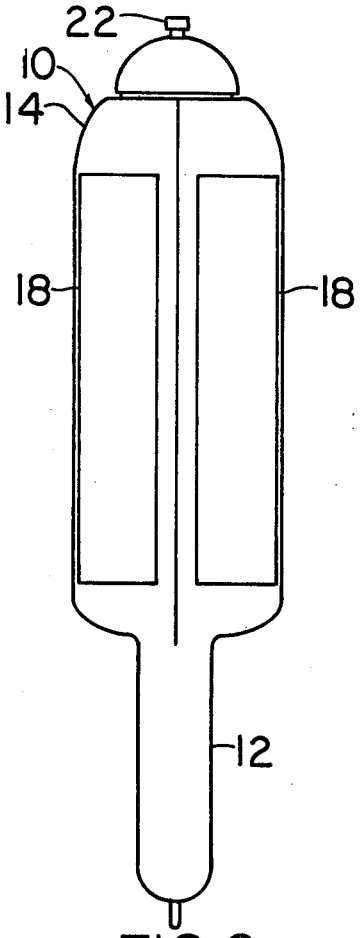
FIG. 6 is a side elevational view of the embodiment illustrated in FIGS. 2 and 5 to continue indicating the locations of the solid prisms.
Figure 8:
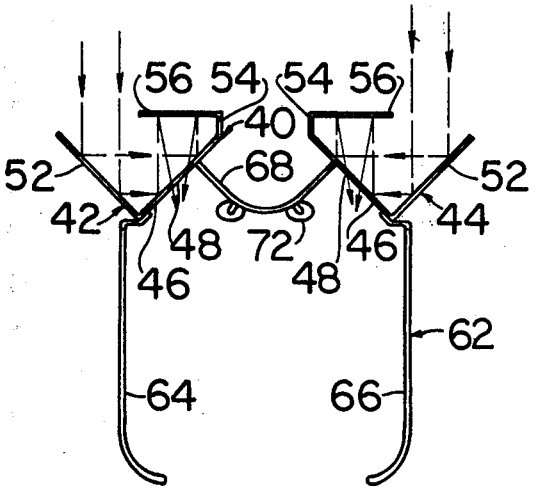
FIG. 8 is a cross sectional view taken on a horizontal geometric plane passing through the eye openings of the embodiment shown in FIG. 4, and light parts are shown by respective lines and arrows to thereby illustrate the reversal of the images.

As illustrated in FIGS. 4 and 8, a person may put on an embodiment, like wearing eye glasses, of the optical toy 40, and individually or with a group try to play a game like the contest illustrated in FIG. 1, wherein he or she will try to stop ahead along the rope 24 or other path on the floor or on the ground, the image of which is reversed by the optical toy 40, making such progress along the rope quite a challenge. Several reflective surface units are arranged in a respective group 42 on one side, and in a respective group 44, of opposite hand on the other side, each located opposite a respective eye of the participant.

Each of these groups of reflective surface groups 42, 44 has a reflective surface unit nearest the eye 46, with a small view hole 48, arranged on a forty-five degree angle pointed inwardly toward the overall center of this embodiment 40. Also each of these groups 42 have another reflective surface unit 52 forming a ninety degree apex angle with the reflective surface unit 46 as it is pointed outwardly on a forty-five degree angle. Each reflective surface unit 46 is joined by a small non reflective surface unit 54, which is purely a convenient structural spacing unit. Each unit 54 in turn is joined to a reflective surface unit 56, located at right angles and positioned opposite the line of sight through the small view hole 48 in reflective surface unit 46.

Eye glass like frame members 62 are arranged to include two over ear portions 64, 66 and one over nose portion 68, inclusive of nose rests 72. The over ear portions 64, 66 are joined to the groups of reflective units near the apex of the reflective surface units 46, 52. The nose portion 68 is joined between the reflective surface units 46, one on each side, of opposite hand in respect to the pointed angles, but both being pointed inwardly with respect to the eye glass like frame members 62.

REGARDING THIS OPTICAL TOY'S REVERSING OF THE SIGHTED IMAGES

Figure 7:
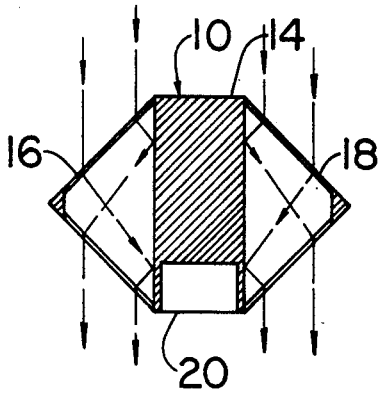
FIG. 7 is a cross sectional view taken on a geometric plane indicated by the sectional line 7—7 of FIG. 5, and light paths are shown by respective lines and arrows to thereby illustrate the reversal of the images.

In FIGS. 7 and 8, by using broken lines and arrows, the light paths are indicated throughout their travel with respect to solid optical prisms 16, 18, in FIG. 7, and with respect to the groups 42, 44 of reflective surface units in FIG. 8. The reflective surfaces become effective in each of these embodiments to redirect the light paths so the sighted images are reversed.

The participant in a game, such as illustrated in FIG. 1, must redirect his or her thinking to move his or her foot either to the right or left or straight ahead. His or her foot must be moved in the opposite direction to the normally viewed direction, because of this optical toy's reversal of the sighted image. Therefore this optical toy in its various embodiments is used by one or more in a very entertaining way as they try to cope with this need for redirecting their thinking and their resulting motions.

We claim:

1. An optical game comprising:

(a) selectively positionable means for making a pathway which is adapted to be attempted to be walked by a participant while playing said game; and (b) a sighted image reversing optical toy comprising:

(i) at least one means for reversing sighted images left to right and vice versa, so a participant sees his left foot on his right side and vice versa; and (ii) a support means positionable before said participant's eyes which carries said at least one means for reversing sighted images; wherein during said game said participant looks through said optical toy and attempts to walk said pathway despite his seeing reversed sighted images through said optical toy.

2. The apparatus according to claim 1, wherein said means for reversing sighted images is elongated, to enable said participant to have a large field of view in what is a generally vertically oriented direction during use of said toy so said participant may easily view at least one of his feet as well as a substantial portion of said means for making a pathway to enable said participant to attempt to walk said means for making a pathway.

3. The apparatus according to claims 1 or 2, wherein said means for reversing sighted images comprises a right angle prism, and the participant, during use of said toy, looks through the two sides of said prism which intersect in said right angle.

4. The apparatus according to claim 3, wherein said prism is at least about two inches long so said participant may easily view at least one of his feet as well as a substantial portion of said means for making a pathway to enable said participant to attempt to walk said means for making a pathway.

5. The apparatus according to claim 3, wherein said prism has a length of at least about equal to one-half the distance from said participant's eyebrow to his chinline.

6. A sighted image reversing optical toy especially adapted for playing a game in which a participant, while looking through said toy, tries to walk a foot pathway means, wherein said optical toy comprises:

(a) at least one elongated means for reversing sighted images left to right and vice versa so said participant sees his left foot on his right side and vice versa, wherein the elongated nature of said means for reversing sighted images is necessary to enable said participant to have a large field of view in what is a generally vertically oriented direction during use of said toy, so said participant may easily view at least one of his feet as well as a substantial portion of said pathway means to enable said participant to attempt to walk said pathway means during same game; and (b) a support means, positionable before said participant's eyes, which carries said at least one means for reversing sighted images;

wherein said means for reversing sighted images comprises first, second, and third angularly disposed reflecting surfaces having fluid located therebetween, wherein said second reflecting surface defines a hole through which the reversed sighted image is emitted, wherein said first reflecting surface is at about a ninety degree angle with respect to said second reflecting surface, said second reflecting surface is at about a forty-five degree angle with respect to said third reflecting surface, and at least a portion of said first reflecting surface extends beyond said third reflecting surface; and wherein light passing beyond said third reflecting surface is reflected from said first reflecting surface to said second reflecting surface, from whence it is reflected to said third reflecting surface, from whence at least a portion of said light is reflected through said hole in said second reflecting surface where the reversed sighted image may be viewed by said participant.

7. An optical game comprising:

(a) selectively positionable means for making a foot pathway which is adapted to be walked by a participant while playing said game; and (b) a sighted image reversing optical toy comprising:

(i) at least one means for reversing sighted images left to right and vice versa so a participant in said game sees his left foot on his right side and vice versa; and (ii) a support means positionable before said participant's eyes, which carries said at least one means for reversing sighted images; wherein during said game participant looks through said optical toy and attempts to walk said pathway despite his seeing reversed sighted images through said optical toy;

wherein said means for reversing sighted images comprises first, second, and third angularly disposed reflecting surfaces having fluid located therebetween, wherein said second reflecting surface defines a hole through which the reversed sighted image is emitted; wherein said first reflecting surface is at about a ninety degree angle with respect to said second reflecting surface, a second reflecting surface is at about a forty-five degree angle with respect to said third reflecting surface, and at least a portion of said first reflecting surface extends beyond said third reflecting surface; and wherein light passing beyond said third reflecting surface is reflected from said first reflecting surface to said second reflecting surface, from whence it is reflected to said third reflecting surface, from whence at least a portion of said light is reflected through said hole in said second reflecting surface where the reversed sighted image may be viewed by said participant.

* * * * *